United States Patent [19]

Stark

[11] Patent Number: 4,782,643

[45] Date of Patent: Nov. 8, 1988

[54] ARRANGEMENT FOR THE CONTINUOUS HEAT TREATMENT AND PACKAGING OF A LIQUID PRODUCT

[75] Inventor: Sven O. S. Stark, Sjörup, Sweden

[73] Assignee: Tetra Pak International AB, Lund, Sweden

[21] Appl. No.: 55,320

[22] Filed: May 29, 1987

Related U.S. Application Data

[60] Division of Ser. No. 39,761, Apr. 17, 1987, Pat. No. 4,731,250, which is a continuation of Ser. No. 700,004, Feb. 8, 1985, abandoned.

[30] Foreign Application Priority Data

Feb. 16, 1984 [SE] Sweden ..... 8400827

[51] Int. Cl.[4] ..... B65B 55/06; B65B 55/14

[52] U.S. Cl. ..... 53/127; 53/167; 53/550

[58] Field of Search ..... 53/127, 167, 530, 550, 53/425, 440; 426/234, 243, 244, 247, 399, 400, 401, 407, 412, 522; 422/21, 25

[56] References Cited

U.S. PATENT DOCUMENTS

| | | | |
|---|---|---|---|
| 1,810,864 | 6/1931 | Vogt | 53/550 X |
| 2,070,850 | 2/1937 | Trabold | 426/412 |
| 2,550,584 | 4/1951 | Mittelman | 426/427 |
| 2,613,488 | 10/1952 | Attride | 426/412 |
| 2,759,308 | 8/1956 | Nawrock | 53/127 |
| 2,816,837 | 12/1957 | Horsman | 426/412 |
| 3,052,559 | 9/1962 | Peerles | 426/412 |
| 3,913,299 | 10/1975 | Stenstrom | 53/127 |
| 3,961,569 | 6/1976 | Kenyon | 426/412 |
| 4,265,922 | 5/1981 | Tsuchiya | 426/244 |
| 4,642,969 | 2/1987 | Johnson | 53/550 X |

*Primary Examiner*—John Sipos

*Attorney, Agent, or Firm*—Burns, Doane, Swecker & Mathis

[57] ABSTRACT

The invention relates to an arrangment for the continuous heat treatment and packaging of a liquid product with the object of sterilizing the product, the product being heated for a short time together with, and surrounded by, the packing material wherein it is to be enclosed. The product is introduced into a tube of flexible material whereupon the tube containing the product is introduced between two parallel metal bands, movable synchronously in their longitudinal direction, the tube being received and compressed between the bands so that the tube is transported with the bands at the same time as the cross-sectional area of the tube is reduced and the product is made to flow forward through the compressed tube in a gaplike space. Heat is transmitted to the product with the help of the metal bands (1) while the product present between the metal bands is kept under pressure. After the heating required for sterilization, the product is cooled and while it is still in the tube, is made to emerge and be freed from the metal bands, whereupon the tube and the product are divided into individual packing units through repeated transverse sealing of the tube.

12 Claims, 4 Drawing Sheets

1
2
3
4
5
6
7
8
9
10
11
12
13
14
15
16
17
18
19
20
K
V
V0
V1
V2

1
3
6
11
35

1
3
6
11
18

ARRANGEMENT FOR THE CONTINUOUS HEAT TREATMENT AND PACKAGING OF A LIQUID PRODUCT

This application is a divisional of application Ser. No. 39,761, filed Apr. 17, 1987, now U.S. Pat. No. 4,731,250 which is a continuation of Ser. No. 700,004 filed Feb. 8, 1985, now abandoned.

BACKGROUND AND SUMMARY OF THE INVENTION

The present invention relates to an arrangement for the continuous heat treatment and packaging of a liquid product, in particular with the object of reducing the content of micro-organisms of the product, the product being heated for a short time together with, and surrounded by, the packing material in which it is to be enclosed and subsequently cooled again. The invention also relates to an arrangement for the carrying out of the method.

In the technique of packaging, products to be packaged are subjected to a heat treatment before the actual packaging, mostly in order to reduce the content of bacteria and other micro-organisms in the product. It is of course primarily foodstuffs which are subjected to such a heat treatment, the ultimate object of the heat treatment being in general the prolongation of the keeping quality of the product. If the heat treatment is carried out long enough to prevent all bacterial growth, it is said, in general, that the product has been sterilized, which means that it can be kept in its package for a very long time (a number of months) without the product turning sour or being impaired in some other manner through micro-biological effects. It is a pre-condition, however, if the product is to remain durable in its package, that the packaging of the product has to be carried out under aseptic conditions and that the parts of the packing material which come into contact with the sterilized contents are aseptic.

It is known that milk, fruit juices, water etc. can be sterilized by means of heat treatment and subsequent packaging of the sterilized product under aseptic conditions into previously sterilized packing material, whereupon the packed product can be kept in its unopened package for a very long time. This packing process, in principle, is divided into two stages, namely:

(a) heat treatment of the product with the object of reducing the content of micro-organisms, and (b) packaging of the product comprising treatment of the packing material in order to sterilize the surfaces which come into contact with the product.

The heat treatment of the product which for example may be milk, can be carried out in any known apparatus, e.g. a plate apparatus which, in principle, is a heat exchanger where the heat-emitting medium flows along one path of flow and the milk intended for heat treatment flows along an opposite path of flow, the two flow media being separated by thin metal walls which readily transfer thermal energy from the heat-emitting medium to the heat-absorbing medium. Such devices termed "plate apparatuses" are used mainly for pasteurizing milk, that is to say heating to approx. 90° C. in order to neutralize pathogenic bacteria. If a complete sterilization of the milk is to be carried out, a more comprehensive heat treatment and a heating to 140° C. for a few seconds is required. Such a heating, as a rule, is not carried out in the so-called plate apparatuses, but in other types of heating arrangements where usually a jet or a film of milk is made to encounter a flow of superheated steam, the milk being heated rapidly to sterilization temperature. The heat-treated milk can be collected in sterilized tanks or containers awaiting packaging.

For the actual packaging, the sterilized milk is conducted under aseptic conditions to a packing machine wherein a web or a blank of packing material is sterilized internally before the sterilized milk is introduced. This filling and closing process must take place in a sterile room so as to hinder the sterilized milk or the sterilized packing material from being infected by bacteria present in the air.

The most customary and most rational method is to start off with a packing material web with a plastic-coated inside, this packing material web, possibly after treatment with a liquid sterilizing agent, e.g. hydrogen peroxide, being formed to a tube in that longitudinal edges of the web are combined with one another in a tight joint, whereupon the contents are introduced into the internally sterilized tube which, by means of repeated transverse seals, perpendicularly to the tube axis, is divided to form individual package units which can be separated by cutting through the sealing zones. In certain cases the sterilizing effect of the packing material is intensified by allowing the tube of packing material formed in the above-described manner to pass a source of heat which, by means of radiant heat or in some other manner, heats the plastic inside of the tube to such an extent that any micro-organisms present on the packing material web are rendered harmless at the same time as any residues of sterilizing agents are evaporated.

Another method for the manufacture of aseptic packages consists in first making blanks which, with the help of automatic machines, can be transformed to boxes provided with a base. These boxes can subsequently be sterilized on the inside in that hydrogen peroxide is introduced into the packing box in vapour form or in the form of small liquid particles, whereupon hot air or steam is blown into the packing box, on the one hand to enhance the sterilizing effect and on the other hand to eliminate the hydrogen peroxide. The package thus sterilized on the inside is then filled with sterilized product and closed in a sterile chamber.

Both these known methods for packaging sterilized products, e.g. sterilized milk, are used commercially, but it has proved a major difficulty and factor of uncertainty that the sterilization of the product and the sterilization of the packing material have to be carried out in two separate stages and product and package have to be combined thereafter. The uncertainty lies, among other things, in that the product has to pass a number of valves and pipelines of different types where a risk of infection is always present in pipe joints, valve seals etc.

It would be an advantage, therefore, if the heat treatment could be carried out in one stage in which the product and the packing material would be jointly sterilized and the product enclosed in the packing material. Such a process is known in itself, e.g. from U.S. Pat. No. 3,913,299 which describes an apparatus wherein a product, e.g. milk, is introduced into a plastic tube, this plastic tube being conducted through a heating zone, e.g. heated liquid, and is cooled down again thereafter. During the treatment in the hot bath the tube is compressed between rollers so that it is given a reduced area of flow which means that the liquid which is fed to the tube within the region which has a reduced area of flow will be at a higher speed in relation to the tube. This means that the liquid is given a shorter residence time in the heating zone than the tube of packing material, but owing to the tube being flattened, the column of liquid which runs through the tube will be very narrow so that all parts of the liquid come into good thermal contact with the heated walls of the tube. After heating and cooling, the tube is widened again so that the cross-sectional area increases and the relative speed between liquid and tube diminishes. At the actual packing, the speeds of the liquid and of the tube will be the same.

Such a known arrangement has the disadvantage, however, that it is difficult to carry on the heat treatment so long as the liquid which passes through the tube is heated to a temperature which exceeds its boiling point. A boiling of the liquid brings about a formation of steam which renders the process impossible and which prevents further heating. It is necessary therefore that the treatment should be done under pressure so that the liquid can be heated to approx. 140° C. without boiling. To this end, a pressure of approx. 2.6–3 atmospheres above atmospheric pressure is required, that is, a pressure which the actual tube cannot withstand if the tube material consists of a thin plastic film, especially if the tube is heated to a temperature which exceeds the softening point of most plastic materials.

This technical problem has been solved, however, in accordance with the invention by an arrangement which is characterized in that the product is introduced into a tube of flexible material, whereupon the tube containing the product is introduced between two substantially parallel bands movable synchronously in their longitudinal direction, and made preferably of heat-conducting material. The tube is received and compressed between the bands so that the tube is transported with the bands at the same time as the cross-sectional area of the tube is reduced and the product is made to flow forward through the compressed tube in a gaplike space of substantially uniform gap width. Heat is generated in, or is transferred to a zone of the movable bands which, through conduction and convection, transfer the thermal energy required for the treatment to the tube and the product contained in the tube. The tube and the product, after the heat treatment has been carried out during the necessary period, are cooled through thermal energy being given off to, or through another zone of the said bands.

BRIEF DESCRIPTION OF THE DRAWINGS

An embodiment of the invention will be described in the following with reference to the attached schematic drawing wherein.

For the sake of clarity, the same reference designations are used in the following for the different parts, even if they occur in different figures.

DETAILED DESCRIPTION OF THE PREFERRED EMBODIMENTS

Figure 1:
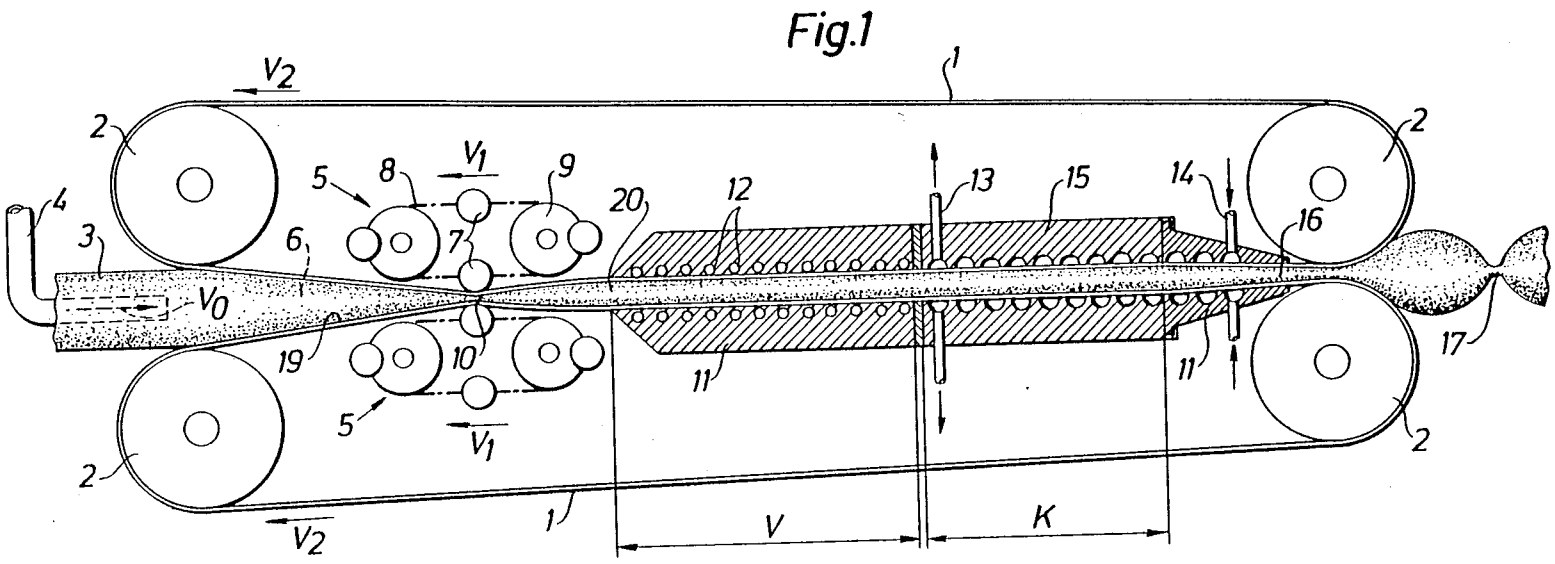
FIG. 1 shows a schematic picture of the arrangement in accordance with the invention.

In FIG. 1 is shown schematically the arrangement and its operation.

Figure 1A:
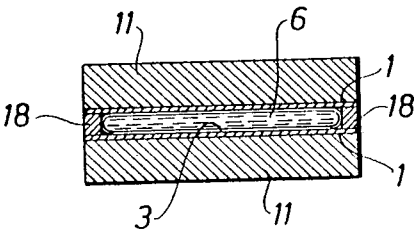

As can be seen from FIG. 1 the arrangement consists of two endless bands 1 which are assumed here to be steel bands but which may also be other, preferably thermally conducting, bands or reinforced plastic bands. The steel bands 1 are passed over, and driven by, pulleys 2 which are arranged so that a synchronous movement is imparted to the steel bands 1. The parts of the steel bands 1 facing one another form a gap 19 and the size of this gap is determined by supporting or guiding surfaces 11 over which the steel bands 1 are conducted. It is intended to introduce into the gap 19 between the steel bands 1 a tube 3 of flexible material, e.g. plastic material, this tube being capable of being filled through a filling pipe 4 with a liquid product 6. The tube 3 which is received between the steel bands 1 in the gap 19 will be flattened as shown in FIG. 1*a*, the product 6 advancing through a gaplike space which is formed in the flattened tube 3. The said gaplike space has a flow area which is substantially smaller than the flow area of the nonflattened tube, which means that the contents 6 which advance through the tube 3 in the parts where the cross-sectional area is reduced will be at a higher speed in relation to the tube than in other parts of the tube 3.

The contents 6 which are introduced through the filling pipe 4 into the tube have, as shown, a speed $V_O$, which in principle corresponds to the rate of feed of the tube 3 if the level of contents in the tube is to be kept constant. The speed v of the contents in the flattened tube, however, is considerably greater and may go up to approx. 10 times the speed $V_O$.

The arrangement is also provided with a pumping device 5 which in the case shown here is a peristaltic pump, that is to say a pump which by means of periodical contractions forces the pumped object to advance through a duct. In the case described here, the pumping device 5 consists of two pairs of driven rollers 9 over which a guide chain or guide way 8 is arranged. On the guide chain or guide way 8 are provided pressure rollers 7. The driving rollers 9 of the pump operate synchronously with one another so that the pressure rollers 7 engage in pairs with one another and between themselves pick up the steel bands 1 together with the parts of the tube 3 present between the steel bands. The compression rollers 7 are controlled so that they compress the steel bands 1 with great force against one another which means that the tube 3 will be closed tightly in the compression region 10. The guide chains 8 are driven along at a speed $V_1$ which is considerably greater than the speed $V_2$ of the steel bands (approx. 5–20 times greater), which means that the rollers will roll along the steel bands 1, with the region of compression 10 being displaced along the steel bands 1 in the direction of advance of the steel bands. The pumping device 5 is designed so that any two compression rollers 7 which engage with one another do not release contact with one another before the rollers 7 coming next in the pumping cycle have fully engaged with one another. Hence the pumping arrangement 5 functions so that at least one pair of rollers 7 is always in engagement with one another.

With the help of the pumping device 5 the liquid product 6 is pumped forward in the direction of feed of the tube into a pressure zone 20 where the pressure is approx. 2.7–3 atmospheres above atmospheric pressure. The pressure is achieved partly with the help of the pump and partly with the help of supporting elements 11 of the steel bands with the help of which the gap 19 between the steel bands 1, and consequently the compression of the tube 3, is controlled.

The flattened tube 3 filled with pressurized product 6 is now introduced into a heating zone V, where heat is supplied to such an extent that the product is heated to approx. 140° C. which owing to the pressure having been raised can take place without the product coming to the boil. Moreover, a packing material is heated to such an extent that its inside becomes sterile. In the example given here, heat is supplied by providing magnetic induction coils 12 in the supporting elements 11 of the steel bands 1. With the help of the magnetic induction coils, eddy currents are induced in the zone of the steel bands 1 which lies next to the induction coils, with the result that the steel bands 1 are heated and by means of conduction and convection, transfer heat to the tube 3 located between the steel bands 1 and, hence, to the product 6.

The product 6 which, as supplied through the filling pipe 4 had a temperature of approx. 80° C., is heated successively in the heating zone V to 140° C. at which temperature the product is to be held for approx. 4–6 seconds. Subsequently the product must be rapidly cooled; however, so that it does not acquire an unpleasant, boiled taste, this takes place in the cooling zone K. In the cooling zone K, the supporting elements 11 are provided in the contact surfaces between the supporting elements and the steel bands 1 with channels 35 through which can flow cooling liquid. This cooling liquid may, for example, be water which is pumped through the channels 35, cooling on the one hand the steel bands 1 while on the other hand the heat absorbed can be used for the preheating of the product 6 intended for sterilization, in a manner which will be described later. When the cooling medium cools the steel bands 1 the temperature of the steel bands will drop, the thermal energy will be transferred from the product 6 to the steel bands 1, so that the temperature of the product 6 rapidly drops and that at the end of the cooling zone it has a temperature of approx. 20° C.

However, the product 6 inside the tube 3 continues to be under a pressure of approx. 3 atmospheres above atmospheric pressure and this pressure has to be relieved before the support can be removed from the steel bands 1. This pressure relief is achieved in the throttling zone 16, in which zone the gap between the steel bands 1 is reduced further in that the supporting elements 11 are brought together more closely either in such a manner that a parallel gap is obtained which is substantially smaller than the gap 19 between the steel bands which exists in the heating and cooling zone, or in such a manner that the distance between the steel bands diminishes successively towards the driving pulleys 2 of the steel bands. Thus the liquid resistance in the gap is made use of for reducing the pressure in the tube 3 to normal atmospheric pressure. The size and shape of the gap in the throttling zone varies depending on the viscosity of the product 6 treated. For this reason the supporting elements 11 in the throttling zone 16 should be adjustable so that the gap can be adapted to allow the desired pressure reduction to be obtained.

The tube 3 which loses the support between the steel bands 1 will expand and the relative speed between the product and the tube once more will become insignificant owing to the increase in the cross-sectional area of the tube. The said tube 3 filled with liquid 6 can be divided in a known manner into packing containers by means of repeated transverse seals in regions perpendicular to the tube 3, whereupon the sealed and divided packages can be separated to individual packing units with the help of cuts through the said sealing regions 17.

As is evident from FIG. 1*a* fixed or movable side supports 18, if required, may be provided between the outer edges of the steel bands 1 so as to support the side edges of the flattened tube 3 if the pressure on these parts of the tube happens to be excessive. In general, the tube 3 ought to be able to absorb these forces against the parts of the side walls exposed between the steel bands 1 without outer support because the gap between the steel bands is very small, but as mentioned, fixed supporting walls 18 may be provided if necessary between the steel bands 1 within the zones where the interior of the tube 3 is under pressure, or else an endless, narrow belt, which is driven at the same speed as the steel bands 1, may be arranged between them on either side of the steel bands so that friction between the tube 3 and the supports 18 is avoided.

It should be pointed out that FIG. 1 is not true to scale but that in a typical case the tube 3 is compressed so much that the gap between the steel bands 1 becomes approx. 4 mm or less. The diameter of the tube 3 of circular cross-section may in practice be approx. 10–20 cm and the thickness of the steel bands approx. 0.5 mm.

The schematic arrangement which is shown in FIG. 1 may in practice certainly be designed in many different ways and one possible design of such an operating arrangement will be described in more detail herein below.

The peristaltic pump 5 can be in the form as described schematically above and as will be described in greater detail in the following, but it is also possible to arrange the pump 5 in such a manner that only one "chain" 8 with pressure rollers 7 is made to rotate and that these press the steel bands 1 against a fixed, hard base. It is also possible to arrange two pressure rollers 7 on movable arms, one of the rollers together with its arm being made to roll over a certain distance along the steel bands 1 and thereby displace the compression zone 10, whilst the other pressure roller 7 is moved against the direction of the bands to a starting position where the roller 7 is pressed against the bands 1. The principle is the same, namely that one roller or a pair of rollers shall always be in engagement with the bands 1 and that the tube 3 shall always be compressed so as to pinch off the pressure zone 20 from the inlet end of the tube 3.

In FIGS. 2*a, b* and *c* is shown a pump 5 of the type as shown in FIG. 1, namely a pump consisting of a guide chain or carrier chain 8 which carries rotating pressure rollers 7 which are supported on axle spindles carried by the chain 8. The rollers 7 are pressed against one another either through the driving chain 8 being controlled by a compression plate 21 or through the axle spindles of the rollers running in control grooves 22, which are indicated in FIG. 2*a*. In FIG. 2*b* the pump is shown in another pumping cycle with only one pair of rollers 7 engaged with one another. The movement of the steel bands 1 in the vertical direction is controlled with the help of fixed supporting elements 11 which in the pumping zone are constituted of rails 24, these rails being located in the manner as shown in FIG. 2*c* in recesses 23 in the rollers 7. The rails 24 thus function as supports of the bands 1 and limit the movement of the bands in the vertical direction when the pressure in the tube 3 varies in rhythm with the working cycles of the pump 5. As mentioned earlier, the contraction zones or compression zones 10 will move along the bands 1 and thereby advance the product 6 which is present in the tube 3 towards the pressure zone 20. This means that the rollers 7 have to roll forward at a higher speed than the bands 1 and the tube 3 which are advanced at a synchronous speed. In reality, the rolling speed of the rollers 7 is approx. 5–20 times greater than the speed of advance of the bands 1 (a typical value is 10 times the band speed).

As mentioned earlier, the pumping problem may be solved in another manner different from that indicated here, but it has been found that the solution with two chains 8 with co-operating pressure rollers 7 is to be preferred over a chain where the pressure rollers 7 work against a hard base, since the limited flexibility of the steel bands 1 brings with it a smaller quantity of contents that can be pumped forward if only the one steel band 1 can bulge out to give space for the product, and this design, furthermore, has the inconvenience that sliding between steel bands 1 occurs, since the bulged out part of the steel band 1 will be somewhat longer than the part of the opposite steel band 1 which rests against a plane base.

Figure 2:
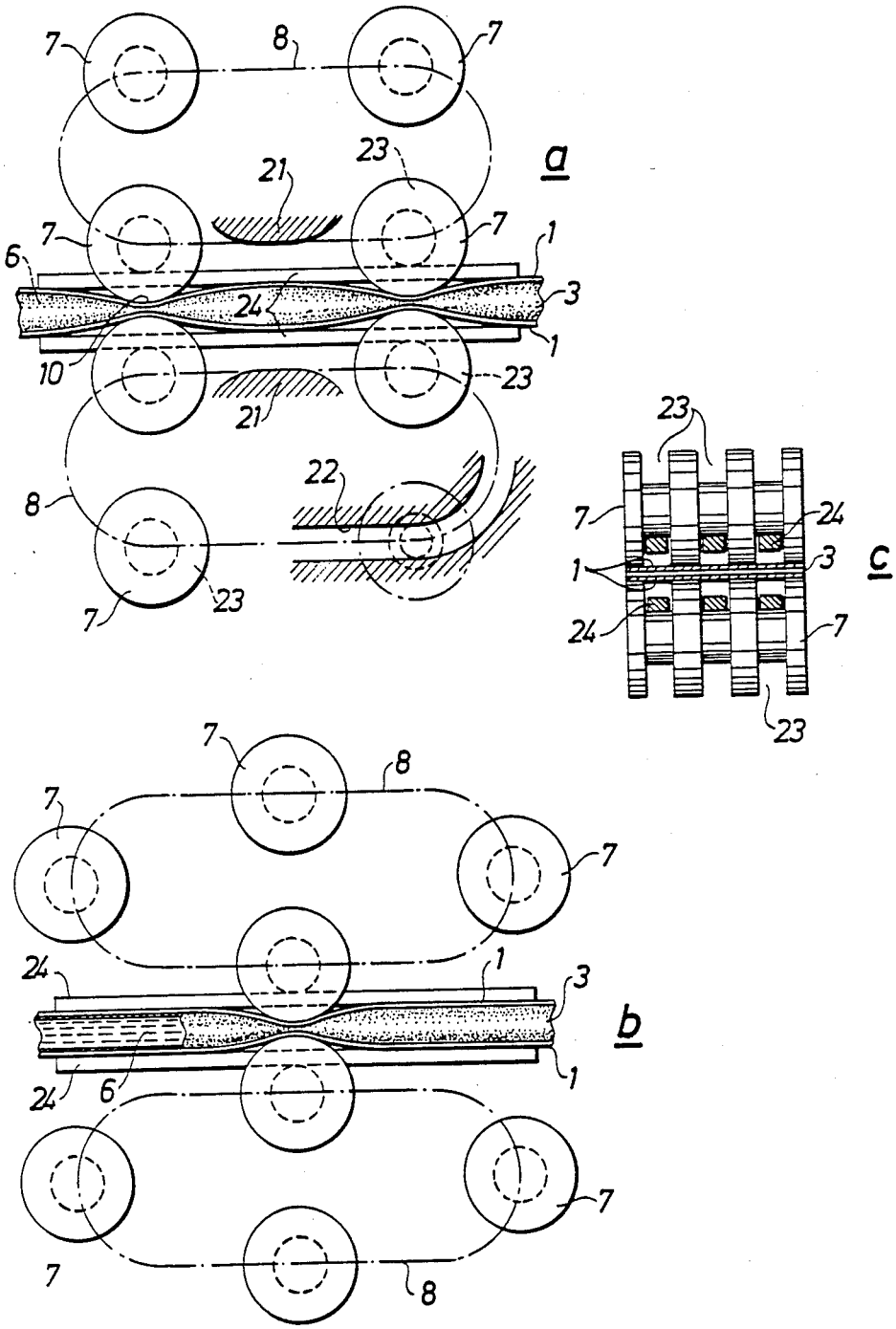
FIGS. 2*a–c* show a pumping device.

A pump 5 of the type which is shown in FIG. 2 gives a pulsating pumping which produces undesirable pressure variations in the system. This can be remedied through the introduction of a so-called equalizing device 27 which in principle comprises supports 11 for the steel bands 1 over a certain limited distance which are resilient so as to allow a widening of the steel bands 1 and hence a widening of the tube 3 when a pressure surge occurs. In the equalizing device 27 the tube 3 can thus be widened temporarily and acquire locally a larger volume which means that the pressure can be rapidly levelled out and that after passing the equalizing device 27 the pressure in the product 6, by and large, will be constant and independent of the pressure surges which are generated by the pumping device 5.

Figure 3:
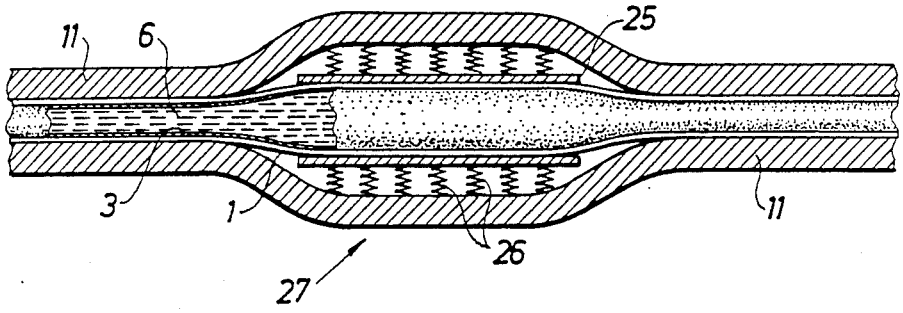
FIG. 3 shows an equalizing device.

Purely practically, the equalizing device 27 can be designed in many different ways. In FIG. 3 is shown an embodiment which consists in widening the supporting plates 11 within a region and providing in the region pressure plates 25 which are spring-loaded by means of springs 26. The pressure plates 25 are resilient and rest directly against the bands 1. When a pressure surge occurs the pressure in the tube 3 is increased and hence the pressure between the tube 3 and the steel bands 1 and also between the steel bands 1 and the supporting surfaces 11. This increasing pressure has the effect that in the region of the resilient supporting plates 25 these plates will spring backwards and locally provide a larger space for the product 6 in the tube 3 so that the pressure is quickly levelled out.

To achieve a reduction in the friction between the steel bands 1 and the supporting plates 25 the underside of the latter can be provided with rolls placed tightly next to each other. Instead of using springs 26, it is also possible to make the supporting arrangement 11 resilient in the region of the equalizing device 27. The main thing is that the tube 3 should have an opportunity to expand locally and provide a larger space for the product 6 within the widened zone so as to neutralize any pressure surges from the pumping device 5.

Figure 4:
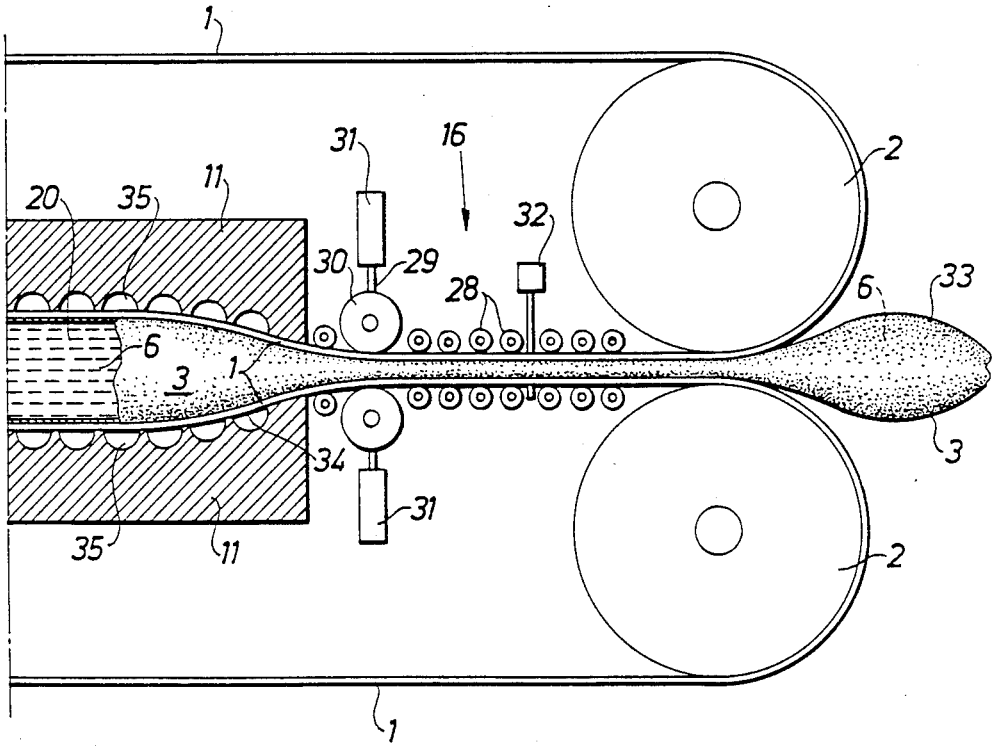
FIG. 4 shows a throttling device for the equalization of the pressure.

From the equalizing device 27 the tube passes into the heating zone 50 and the cooling zone for heat treatment which will be described later. In these zones, as mentioned, there is a pressure of approx. 3 atmospheres above atmospheric pressure in order to prevent the product from being brought to boiling point during the heating. This pressure has to be reduced to atmospheric pressure or near atmospheric pressure before the support of the tube 3 by the steel bands 1 can end. In the present case it is assumed that the reduction of the pressure in the tube 3 is achieved with the help of the liquid resistance which is produced when the product in the tube 3 is conducted through a throttling zone 16. In FIG. 4 is shown how such a throttling zone 16 can be arranged. As is evident from FIG. 4 the steel bands 1 are supported and guided by supporting elements 11 and at the conclusion of the pressure zone 20 the steel bands 1 are led towards one another so that the gap between the steel bands 1 is further diminished. This means also that the tube 3 is further squeezed together so that the area of flow for the product 6 is appreciably diminished. Since the steel bands 1 cannot be bent over a narrow bending radius, the diminution of the gap between the steel bands 1 occurs in a transition zone 34 where the walls of the supporting elements 11 lead the steel bands towards one another until the gap between the steel bands 1 has diminished appreciably to required size (e.g. from a gap in the pressure zone of 4 mm to a gap in the throttling zone of 0.5–0.6 mm). Because of the liquid resistance the pressure in the tube 3 decreases successively, but since some pressure remains the steel bands 1 must continue to be supported in almost the whole throttling zone which can be done by means of an extension of the supporting elements 11 or by introducing roller mats 28 of the type as shown in FIG. 4. The rollers in the roller mats 28 can be adjustable so that the gap between the steel bands is controllable and this can also be achieved by means of a throttling governor 29 consisting of a pair of rollers 30 which via arms are maneuverable by pneumatic or hydraulic maneuvering pistons 31. The throttling governor 29 may also be constituted, in a manner known in itself, of a regulating screw which is turned by hand when the throttling and consequently the pressure require adjustment. Since the liquid resistance in the throttling zone varies for products with different degrees of viscosity, it is necessary to be able to adjust the gap in the throttling zone so that the pressure in the pressure zone is wholly compensated when the tube 3 ceases to be supported by the steel bands. When the support of the tube 3 by the steel bands ends, a widened part of tube 33 is formed which has such a large area of flow that the difference in speed between the contents 6 and the advancing tube 3 disappears. The widened part of tube 33 containing the product is subsequently converted in the manner described earlier to individual packages through repeated transverse sealing of the tube 3 with the help of known packing machines, e.g. those where sealing jaws are provided on controlled chains and the sealing jaws are made to engage in pairs with the tube which is flattened and sealed while being compressed between the sealing jaws. Since the transport chain carries sealing jaws at a certain distance from one another, repeated seals of the tube at equal intervals are obtained. In order that each packing unit should contain the same volume of liquid, however, the driving speed of the chains which carry the sealing jaws must be adapted so that they operate synchronously with the amounts of product 6 and tube 3 fed through. The amount of tube 3 that is fed is always constant since the steel bands 1 and hence also the tube 3 are advanced at a constant rate, while in contrast the amount of product varies somewhat depending on how much product is dispensed to the tube 3. This in turn depends on the pressure in the throttling zone 16 and for this reason a controller 32 is provided which monitors the widening of the tube 3 in the throttling zone 16 to make it possible to control the speed of the chain on the packing machine 62 which carries the sealing jaws, and as a result, obtain packages with a constant volume.

It is also possible with the help of the control in the throttling zone 16 to regulate the pressure in the pressure zone 20, that is to say, should the pressure in the pressure zone be too low, which would imply a risk that the product might boil, further throttling can take place in the throttling zone 16 so that the pressure in the pressure zone 20 increases and vice versa. The accuracy of volume of the package produced is determined by the bag or package filling a fixed cavity in the packing machine. If the speed of the steel bands and of the chain on the packing machine 62 is too low the pressure in the tube 3 before the packing machine 62 will increase and this increase in pressure is monitored by the monitoring device 32. A governor is acted on by the monitoring device 32 with the result that rising pressure on the monitoring device 32 will cause the speed of the steel bands 1 and of the packing machine 62 to increase while diminishing pressure will bring about a decrease in the speed of the steel bands 1 and of the packing machine 62. In this way a constant flow of the product 6 is achieved and the speed of travel of the steel bands 1 to suit this flow is regulated.

Figure 6:
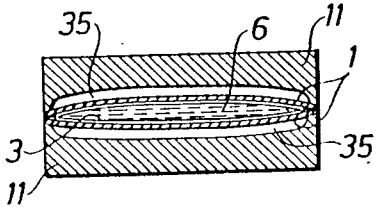
FIGS. 6 and 1*a* show a cross-section through the supporting and guiding surfaces for the control of the steel bands.

As is evident from FIG. 6 the supporting elements 11 are provided with open channels 35 these channels communicating with each other within each zone and being arranged in loops along the steel bands 1. The ducts or channels 35 are connected, in a manner which will be described later, to a pipeline system for the supply of cooling water and drawing off of the cooling water after it has been heated. The steel bands 1 are in direct contact with the opening of the channels 35 and it is ensured that the contact surface of the supporting elements 11 with the steel bands 1 is so uniform that a substantially water-tight contact is obtained. To achieve further tightening the steel bands 1 are pressed against the sliding surface of the supporting elements 11 under pressure. This pressure must not be too great, though, since otherwise the friction forces become so great that it becomes difficult to move the steel bands 1 along while they are in contact with the supporting elements 11. The steel bands 1 are pressed against the supporting elements 11 owing to a pressure of approx. 3 atmospheres above atmospheric pressure prevailing in the pressure zone 20 which, owing to the relatively great length and width of the pressure zone, provides appreciable contact forces. These contact forces are neutralized, however, because the cooling water which is introduced into the channels 35 has a pressure which is only a few tenths of an atmosphere less than the pressure in the pressure zone 20 of the tube 3, which means that it is only the difference between the pressure in the pressure zone 20 and the pressure in the cooling water channels 35 which is effective between the steel bands 1 and the sliding surfaces of the supporting elements 11. This pressure must always be positive, though, so that a sealing of the channels 35 is obtained, since otherwise the cooling medium (water in the present case) would squirt out between the steel bands 1 and the supporting elements 11. In the supporting elements 11 induction coils 12 are inserted in the heating zone 50 in order to permit heating of the steel bands within the heating zone. These induction coils are fed in known manner (not shown here) by means of a high-frequency generator, and with the help of the coils eddy currents are induced in the steel bands 1. These eddy currents generate heat in the material and this heat is subsequently transferred by convection to the tube 3 and the product 6.

As is evident, the edge zones 36 of the tube 3 are not supported by any pressure-absorbing arrangement. As mentioned earlier, this does not generally produce any major problem, since the forces in these edge zones are not great, as the gap 19 between the steel bands 1 is only small. However, it has to be borne in mind that the material in the tube 3, if it is a plastic material, will be weakened through heating which means that it is easily extended and deformed. In these cases it is necessary to support the edge zones, which can be done in the manner mentioned earlier by means of outer supporting devices 18 which are introduced between the edge zones of the steel bands, and which are preferably driven synchronously at the same speed as the bands 1 and the tube 3 so as to prevent friction between the tube edge and the supporting surface 18. Another manner of solving this problem is shown in FIG. 6 where the supporting elements 11 have a concave contact surface against the steel bands 1 which means that the supporting elements 11 successively force the edge zones of the steel bands towards one another, or at least bring them so near to one another, that the width of the edge zones of the tube 3 is substantially reduced. By closing the pressure zone space for the tube 3 in this manner, the latter will be supported in all its parts, thus preventing any deformation of the tube material even if it is heated to softening. In this manner the problem of the tube 3, if made of plastic film of losing important parts of its mechanical properties is eliminated.

It is further necessary to adapt the bands 1 to the material which is present in the tube 3 and it may be suitable in certain cases to provide the steel bands 1 with a coating of teflon or similar material in order to prevent "sticking" between the warm plastic tube 3 and the steel bands 1 when the plastic tube is heated to temperatures which substantially exceed the softening temperature of the plastics.

It is not necessary of course to supply heat electrically with the help of induction coils. It is also possible to supply heat to the bands 1 by means of a heated liquid medium which is conducted in the said channels 35 within the heating zone 50. These channels in the heating zone will then form a separate channel system. In general it is difficult, however, to reach a sufficient temperature in this manner, so that the main importance of heating by means of liquid heating medium rests perhaps in heat treatment not aiming at full sterility but being limited to lower temperature, e.g. pasteurization. The principle of the arrangement thus lies in supporting the tube 3 and the packing material in the tube 3 within the zones which, owing to the heat, have inferior strength characteristics so as to prevent deformation or bursts in the tube 3 at the same time as the pressure in these zones has to be high enough to prevent steam formation in the product 6.

Figure 5:
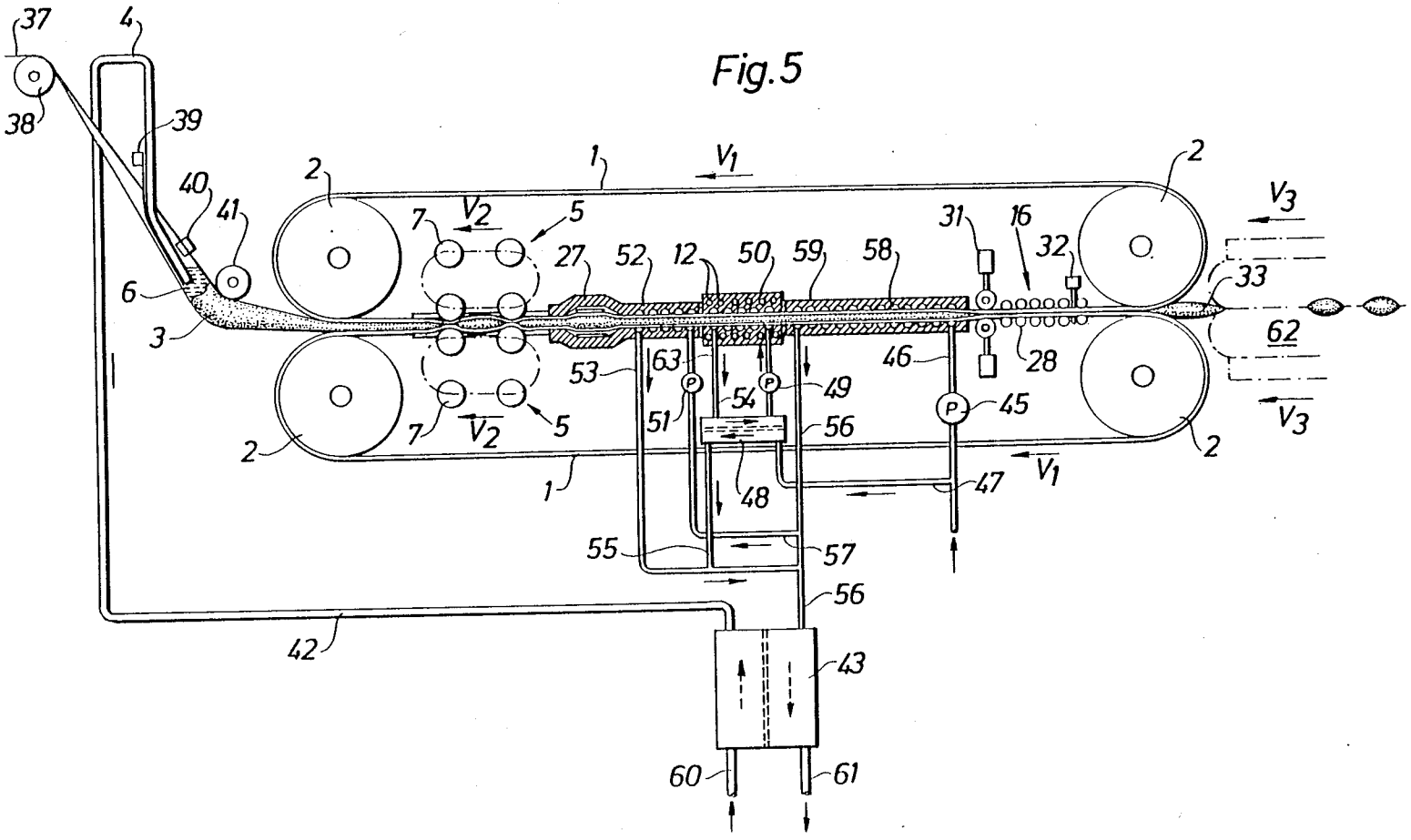
FIG. 5 shows an assembly of the arrangement as a whole.

In FIG. 5 is shown schematically an arrangement in accordance with the invention where the different parts described earlier have been assembled to a unit and where moreover the cooling and heat exchange system can be explained more fully in its principle.

As is evident from FIG. 5 a packing material is rolled off a magazine roll, not shown, in the form of a web 37. In the present case, it is assumed that the web 37 consists of plastic film of e.g. polyethylene, polypropylene, polyester or some other suitable plastic material or some laminate comprising a number of different materials. As will be described later, the packing material web 37 may also consist in certain cases of a material with a base layer of paper or cardboard which may contain e.g. an aluminium foil layer as one of the laminate layers.

The packing material web 37 is conducted over a deflection roller vertically or obliquely downwards with simultaneous formation of the web 37 to a tube 3 by combining edge zones of the web 37 with one another in a joint, the edge zones being sealed with the help of a longitudinal joint sealing device 40 of conventional type. The contents 6 are introduced into the tube 3 formed through the filling pipe 4 and the supply of the contents 6 is regulated by means of a level controller 39 of optional type. Thus it is the intention to attempt holding the level of contents at a relatively constant height which is below the longitudinal joint seal but nevertheless so high that a sufficient static pressure is obtained for the filling and stretching out of the tube 3. The tube 3 is guided successively by means of guide rails or guide pulleys 41 in between the two steel bands 1 described earlier, these steel bands 1 being supported from the inside by means of supporting elements 11 so that an accurately defined gap 19 between the steel bands 1 is obtained. As mentioned earlier, this gap is usually approx. 4 mm, but it may vary depending on packing material, contents, rate of production required etc. When the tube 3 has been introduced between the steel bands 1 it will be flattened down to become almost flat so that the area of flow for the contents 6 consists only of a narrow, elongated passage. This means, as mentioned earlier, that the area of flow for the contents 6 in the tube 3 is substantially diminished. Consequently the contents or the product 6 which in the filling region did not have any flow movement of significance in relation to the tube 3 (constant product level), will now flow through the tube at a speed which is substantially greater than the rate of feed of the tube 3. In the case where the heat treatment aims at sterilization, i.e. where the product is to be heated to approx. 140° C. (milk) and held at that temperature for approx. 4 seconds, the product 6 has to be put under pressure so as not to be brought to the boil. The heat treatment itself thus has to be carried out in a pressure zone 20 where the internal pressure in the tube 3 is substantial (approx. 3 atmospheres above atmospheric pressure), a pressure which the tube 3 cannot withstand, especially when the packing material is heated to a temperature of approx. 140° C., that is to say, a temperature which substantially exceeds the softening temperature of most plastic materials. In the case described here, however, the plastic tube 3 is supported in all parts by the steel bands 1 which thus have a treble function, namely to support the tube 3, to transfer and to absorb heat from the tube 3 and the product 6 and to transport the tube through the treatment arrangement.

In order to attain the desired pressure the product 6 has to be pumped into the pressure zone 20 and this is carried out with the help of a peristaltic pump 5 as described earlier. At least up to and including the pressurizing of the tube 3, the tube 3 must be actively compressed by the steel bands 1 which in turn must be supported by supporting elements 11 which act upon the back of the bands during the whole time the tube 3 is under pressure. This may give rise to friction problems, since the bands 1 are pressed against the supporting elements 11 owing to the internal pressure in the tube 3 and the bands 1 in their movement slide against the supporting elements 11, the contact surface within the pressure zone being essential.

This problem is solved in that e.g. certain parts of the supporting elements 11 are constituted of rollers, e.g. roller mats 28 in the throttling zone 16 (though it should be possible in most cases to substitute the roller mats by sliding surfaces, since the internal pressure in the tube 3 successively diminishes within the throttling zone 16). Within substantial parts of the zones where the tube 3 is under pressure and the steel bands 1 are thus pressed against the sliding surfaces on the supporting elements 11, the problem can be solved with the help of the liquid channels 35 which are provided in the supporting elements 11. The channels 35 are required to conduct cooling liquid which is in contact with the steel bands 1 and absorbs heat from the same, but this cooling liquid may also be used for eliminating or at least reducing the friction problem in respect of the sliding of the bands 1 along the sliding surface of the supporting elements 11. If it is assumed that the internal pressure in the tube 3 is approx. 3 atmospheres above atmospheric pressure the bands 1 will be pressed against the supporting elements 11 with a substantial force because the contact surface is so large. On the other hand, if the liquid pressure in the cooling channels goes up to a value just below the pressure in the tube 3, (e.g. 2.7 atmospheres above atmospheric pressure), the pressure under which the bands 1 are pressed against the sliding surfaces of the supporting elements 11 will be only the differential pressure between the pressure in the tube 3 and the pressure in the liquid channels 35. This means a substantial reduction in the force with which the bands 1 are pressed against the supporting elements and a corresponding reduction in the friction forces which have to be overcome when the bands 1 are made to slide over the sliding surfaces of the supporting elements 11. A certain pressure between the bands 1 and the sliding surfaces of the supporting elements 11 has to be maintained however, since otherwise liquid from the liquid channels 35 would leak out between the supporting elements 11 and the bands 1 which would not be desirable.

When the internal pressure in the tube 3 has risen owing to the product 6 being pumped into the pressure zone 20 with the help of the pressure rollers 7 of the pumping device, pressure surges will occur, as mentioned earlier, since the pumping device 5 produces a pulsating pumping sequence. These pressure surges are eliminated in the manner as described earlier by means of a pressure equalizing device 27 consisting of a resilient, expandable chamber which increases its volume as a pressure surge occurs and as a result the pressure in the tube 3, after passage of the product 6 through the equalizing device 27, will be substantially constant.

The area within which the tube 3 is under pressure can be divided into a number of zones, namely a preheating zone 52, a heating zone 50, a holding zone 59 and a cooling zone 58. These zones, with the exception of the holding zone 59 and the cooling zone 58, are separated from each other in such a manner that the cooling channels 35 in the different zones are included in separate, closed flow systems.

As is evident from FIG. 5, induction coils 12 are provided in the supporting elements 11 in the heating zone 50, these induction coils 12 inducing eddy currents in the bands 1 in the manner as described previously. The said eddy currents induce heat in the bands 1, this heat being transferred subsequently by conduction and convection to the tube 3 and the product 6. Before reaching the heating zone, however, the tube 3 passes through a preheating zone 52 where hot water in the channels 35 is made to heat the product which at the start had a temperature of 120° C. In the heating zone 50 the temperature is raised from approximately 80° C. to a temperature of approx. 140° C., this temperature to be maintained for approx. 4 seconds, which means that the temperature of 140° C. is maintained also after the tube has left the heating zone 50 and has entered into the cooling zone where the temperature of the product 6 and the tube 3 is lowered successively to approx. 20° C. Then the pressure is reduced in the throttling zone 16, in the manner described earlier, to atmospheric pressure. This heat control of the tube 3 and of the product 6 which flows through the tube 3 within the pressure zone 20 at a substantially greater speed than the rate of feed of the tube 3 is achieved with the help of a cooling water circulation system which will now be described in greater detail.

The cooling water of a temperature of approx. 10° C. is introduced through a supply line 44 whereupon the pressure of the cooling water is raised with the help of a pump 45 to a pressure which lies just below the pressure in the tube 3. The pressure of the pump 45 can be regulated with the help of a governor which monitors the pressure in the tube 3 and controls the pump 45 as a function of the monitored result. From the pump 45 the cold cooling water is conducted through a pressure duct 46 into a system of cooling water channels 35 which are arranged within the holding zone 59 and the cooling zone 58 mentioned earlier. The cold cooling water is introduced into the part of the cooling zone 58 which is located foremost in the direction of advance of the tube 3. The cooling water which flows under pressure in the channels 35 reduces, on the one hand, the pressure between the bands 1 and the supporting elements 11 and absorbs, on the other hand, heat from the bands 1 and hence from the tube 3 and the product 6 so that the product at the exit from the pressure zone has a temperature of approx. 20° C. The cooling water flows through the channels 35 with simultaneous absorption of heat and at the start of the cooling zone 58 the continuing product has a temperature of approx. 140° C. which means that the so-called holding zone 59 continues. The cooling water continues to flow through the channels 35 with simultaneous absorption of heat and is drawn off through the duct 56 to a main heat exchanger 43 where the heated cooling water is forced to heat a cold product 6 coming from storage. The cold product (approx. 20° C.) is conducted to the said heat exchanger 43 through a pipeline 60 and in the heat exchanger 43 takes up thermal energy from the outgoing cooling water so that at the outlet from the heat exchanger 43 the product has a temperature of approx. 80° C. The product which has been preheated is conducted through the filling pipe 4 into the tube 3 formed.

Not all the cooling water which is supplied through the pipeline 44 is conducted through the pump 45 and the cooling zone 58, but a part of the cooling water is drawn off through the shunt line 47 and is passed to a secondary heat exchanger 48 whose function consists in absorbing heat from water and cooling the same within a closed system of circulation 63 which is not a cooling system in itself but is used for balancing out the pressure between the bands 1 and the supporting elements 11 so that the friction resistance between the bands and the supporting elements within the heating zone 50 is reduced. This closed circulation system thus incorporates the circulation channels 35 within the heating zone 50, and since the water in this zone is brought to boiling point if it is not allowed to give off heat the separate circulation system 63 has been provided, where the water is circulated with the help of a separate pump 49. The water within the circulation system in the heating zone 50 is conducted therefore through the channels 35 which are provided in the supporting elements 11 in the heating zone 50 and is then conducted through pipeline 63 into a secondary heat exchanger 48 where heat is discharged to the cooling water which passes through the shunt line 47 to the secondary heat exchanger 48. The cooling water heated on its passage through the secondary heat exchanger 48 is then conducted through the pipeline 55 back to the supply duct 56 for the main heat exchanger 43.

The heating zone 52 too has a separate circulation system of channels 35 in the supporting elements 11 and here, as is evident from the name of the treatment zone, it is not a question of some cooling, but of preheating of the product 6. This preheating is achieved in that a part of the cooling water, which has passed through the cooling zone 58 and has been heated in the process, is drawn off through a shunt line 57 and is pumped by means of the pump 51 through the channel system 35 into the preheating zone 52. The product 6 and the tube 3 are heated in this zone to approx. 120° C. The water which has discharged a part of its heat content in the preheating zone 52 is drawn off through pipeline 53 to supply line 56 and hence to the main heat exchanger 43 where the remaining heat content in the water is used for preheating the product 6.

After the pressure reduction in the throttling zone 16, which has been described earlier, the cooled and pressure-reduced tube 3 leaves the bands 1 and is conducted out to atmospheric pressure without support by the bands 1, which means that the tube 3 endeavors to assume a substantially circular cross-sectional area with increasing area of flow and corresponding diminution in the relative speed between the product 6 and the tube 3. The tube 3 is now introduced into any kind of packing machine 62 of known type, e.g. one which has sealing jaws arranged on a rotating chain and where the sealing jaws are pressed against one another from opposite sides of the tube with simultaneous compression and heating of the tube, so that the plastic material is caused to melt to form a tight and durable sealing joint. As the sealing devices on the said chains are arranged at a fixed distance from each other, the tube 3 can thus be pressed flat and sealed at equal intervals to form cushion-shaped packages, or else a shaping of the material of the package may be carried out in association with the sealing operation so that the package acquires a lasting geometric shape or else the bags formed are inserted into containers of cardboard or the like which are manufactured separately.

It has been described earlier how it is possible by regulating the speed of the driven bands 1, the pump 5 or the chain on the packing machine 62 to ensure that the packing containers have a constant and desired volume.

In the present case it has been assumed that the packing material consists of plastic film or plastic film laminate, but it is conceivable that fibrous material such as e.g. paper or aluminum foil may also be included in the laminate. If aluminum foil is included in the laminate it is conceivable that the steel bands might be substituted by rigid bands of some other material, e.g. reinforced plastic bands and that the bands would then have only a supporting, and not any heat-transmitting function. In this case the heat required for the heat treatment can be generated directly in the aluminum foil layer of the packing laminate with the help of the induction coils 12 which are provided in the supporting elements 11. It will be more difficult, of course, to provide an effective cooling if the bands 1 do not have sufficient thermal conductivity, but in certain cases, e.g. when the heat treatment does not have to be carried on as far as sterilization, that is to say heating to 140° C., it is conceivable to use reinforced plastic bands instead of steel bands as supporting devices.

In principle the arrangement may also be used for so-called pasteurization, which has been mentioned in the beginning, and in this case the arrangement will be considerably simpler, since a pasteurization implies only heating of the product 6 up to approx. 90° C. Such heating means, therefore, that a pressure zone 20 does not have to be installed, so that the pumping device 5, the equalizing device 27 and the throttling zone 16 in certain cases can be eliminated. It may be necessary, though, to use a pump, even in pasteurizing devices, for conducting the product 6 through the system. Moreover, the circulation system in the cooling arrangement will be considerably simpler and can be reduced to a channel system and a heat exchanger. When an arrangement in accordance with the invention is to be used for the pasteurizing of milk in connection with packaging of the latter, a tube 3 is manufactured in the manner as described earlier and filled with contents 6. The tube 3 is then pressed flat as it is introduced between two bands 1 supported by the supporting elements 11. As the tube 3 is flattened, a flow duct of a substantially reduced surface is obtained in the tube 3 and the said fast flow of product through the flattened tube 3 will take place. The produce can be heated in the manner as shown through heat transfer from the bands 1 or through the generation of heat in a layer of aluminum foil in the packing material, whereupon the tube 3 with its contents, after the support by the bands 1 has ended can be packaged in a packing machine 62 of known type.

In the embodiment of the invention described here, it is assumed that the pressure relief of the product is carried out with the help of a throttling zone, with the liquid resistance in the said throttling zone used for pressure relief. It may be advantageous in certain cases and for certain products to use instead of the said throttling zone a pump for the pressure relief of the product. Such a pump can be, for example, a peristaltic pump of the same design as pump 5.

It is also possible to generate the heat required for heat treatment direction in the product and the heating can then be done with the help of microwaves using known microwave generators.

Substantial advantages can thus be gained by using an arrangement in accordance with the invention which by no means is restricted to the embodiments here described, but which comprises any embodiments where the tube 3 filled with liquid is introduced between, and is supported by, wide bands 1 which, on the one hand, control the cross-sectional area of the tube 3 and support its walls and on the other hand, supply and/or absorb heat from the tube and the product 6 introduced into the tube.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. Apparatus for the continuous aseptic packaging of a liquid product having a predetermined boiling point comprising: means for advancing a flexible wall tube of packaging material, said means for advancing including a pair of opposed bands arranged to receive said tube between and in frictional engagement with said bands, said bands being arranged to substantially enclose the tube, supporting elements on opposite sides of the tube for restricting expansion of the tube, said bands being interposed between said supporting elements and the tube, means for heating the product in the tube along said supporting elements, and pump means cooperating with said bands for increasing the fluid pressure in the tube as it continuously advances to increase said predetermined boiling point and in combination with the heating means heating the fluid in the tube for sterilization without vaporization.

2. The apparatus according to claim 1 wherein said means for advancing includes a pair of pulleys for each of said pair of opposed bands, said bands each being endless and being mounted on said pair of pulleys with said bands extending from one pulley to the other substantially parallel to and adjacent to each other between the respective pairs of pulleys.

3. The apparatus according to claim 2 wherein said pump means includes two rotating carriers with rollers which are positioned between said pulleys and said supporting elements, said rollers being arranged to engage the respective bands periodically, said rollers being advanced by said carriers in the same direction as said bands, but at a substantially greater speed than said bands, thereby causing pumping of the fluid contents of the tube between said bands.

4. The apparatus according to claim 1 wherein said means for heating includes heat exchangers in said support elements, the liquid product in the tube being heated by thermal conduction through said bands.

5. The apparatus according to claim 1 wherein said means for heating includes magnetic coils in said supporting elements for inducing heating by eddy currents.

6. The apparatus according to claim 1 wherein said supporting elements include resilient walls adjacent said pump means for allowing local expansion of the tube and thereby equalizing pressure surges caused by the pump means.

7. The apparatus according to claim 2 including means for sealing the tube at predetermined intervals after passing between the pulleys at the discharge end of the apparatus, and means for severing the tube along the sealed portion of the tube.

8. The apparatus according to claim 2 including means for sensing the pressure in the tube, and governor means for increasing the speed of said bands in response to an increase in pressure in said tube and for decreasing the speed of said bands in response to a decrease in the pressure in said tube, thereby providing a substantially constant pressure of the liquid product in the tube.

9. the apparatus according to claim 4 wherein the bands are formed of a thermally-conductive material.

10. The apparatus according to claim 9 wherein the thermally-conductive material is steel.

11. The apparatus according to claim 5 wherein the bands are formed of electrically non-conducting material, whereby induction heating may be caused by the presence of a metallic foil laminate in the wall of the tube.

12. The apparatus according to claim 5 wherein said bands are formed of an electrically-conducting material, whereby the eddy currents induce heating of the bands.

* * * * *